US006726602B2

(12) United States Patent
Chang

(10) Patent No.: US 6,726,602 B2
(45) Date of Patent: Apr. 27, 2004

(54) LIFTING AND FOLDING DEVICE FOR RUNNING EXERCISE MACHINE

(76) Inventor: Huang-Tung Chang, P.O. Box 487, Chang-Hua City (TW), 500

( * ) Notice: Subject to any disclaimer, the term of this patent is extended or adjusted under 35 U.S.C. 154(b) by 0 days.

(21) Appl. No.: 10/340,736

(22) Filed: Jan. 13, 2003

(65) Prior Publication Data

US 2003/0224910 A1 Dec. 4, 2003

(30) Foreign Application Priority Data

Jun. 3, 2002 (TW) ..... 91208304 U

(51) Int. Cl.[7] ..... A63B 22/00
(52) U.S. Cl. ..... 482/54
(58) Field of Search ..... 482/51–54

(56) References Cited

U.S. PATENT DOCUMENTS 6,077,200 A * 6/2000 Lin ..... 482/54
6,267,710 B1 * 7/2001 Liu ..... 482/54
6,585,624 B1 * 7/2003 Chen ..... 482/54
6,652,424 B2 * 11/2003 Dalebout ..... 482/54

* cited by examiner

*Primary Examiner*—Stephen R. Crow

(57) ABSTRACT

A lifting and folding device for a running exercise machine comprises an ascending/folding device and an interacting device installed between a base and an exercise platform. By adjusting the ascending/folding device the interacting device is put in a synchronic motion, so as to achieve the effect of adjusting the exercise platform to an uphill, a horizontal or a downhill configuration. Further, the ascending/folding device has a driving device capable of automatically ascending and folding the running exercise machine.

3 Claims, 5 Drawing Sheets

LIFTING AND FOLDING DEVICE FOR RUNNING EXERCISE MACHINE

The present invention relates to a lifting and folding device of running exercise machine, comprising mainly an ascending/folding device, a driving device and a interacting device. As the ascending/folding device being driven by the driving device, the interacting device is put in motion accordingly to fulfill a function of adjusting an exercise platform to an uphill, a downhill or a horizontal configuration. It is a further function by the same mechanism that the running exercise machine can be folded automatically for storage and transportation.

Therefore, the main purpose of the present invention is providing the runner with a variety of exercise modes by being flexible of adjusting slope angle of the exercise platform. It is a secondary purpose that the function of automatic folding provides the convenience of storing and transporting the running exercise machine when it is not in use.

To achieve the object, the present invention provides a lifting and folding device for a running exercise machine comprises an ascending/folding device and an interacting device installed between a base and an exercise platform. By adjusting the ascending/folding device the interacting device is put in a synchronic motion, so as to achieve the effect of adjusting the exercise platform to an uphill, a horizontal or a downhill configuration. Further, the ascending/folding device has a driving device capable of automatically ascending and folding the running exercise machine.

The various objects and advantages of the present invention will be more readily understood from the following detailed description when read in conjunction with the appended drawings.

DETAILED DESCRIPTION OF THE PREFERRED EMBODIMENT

Figure 1:
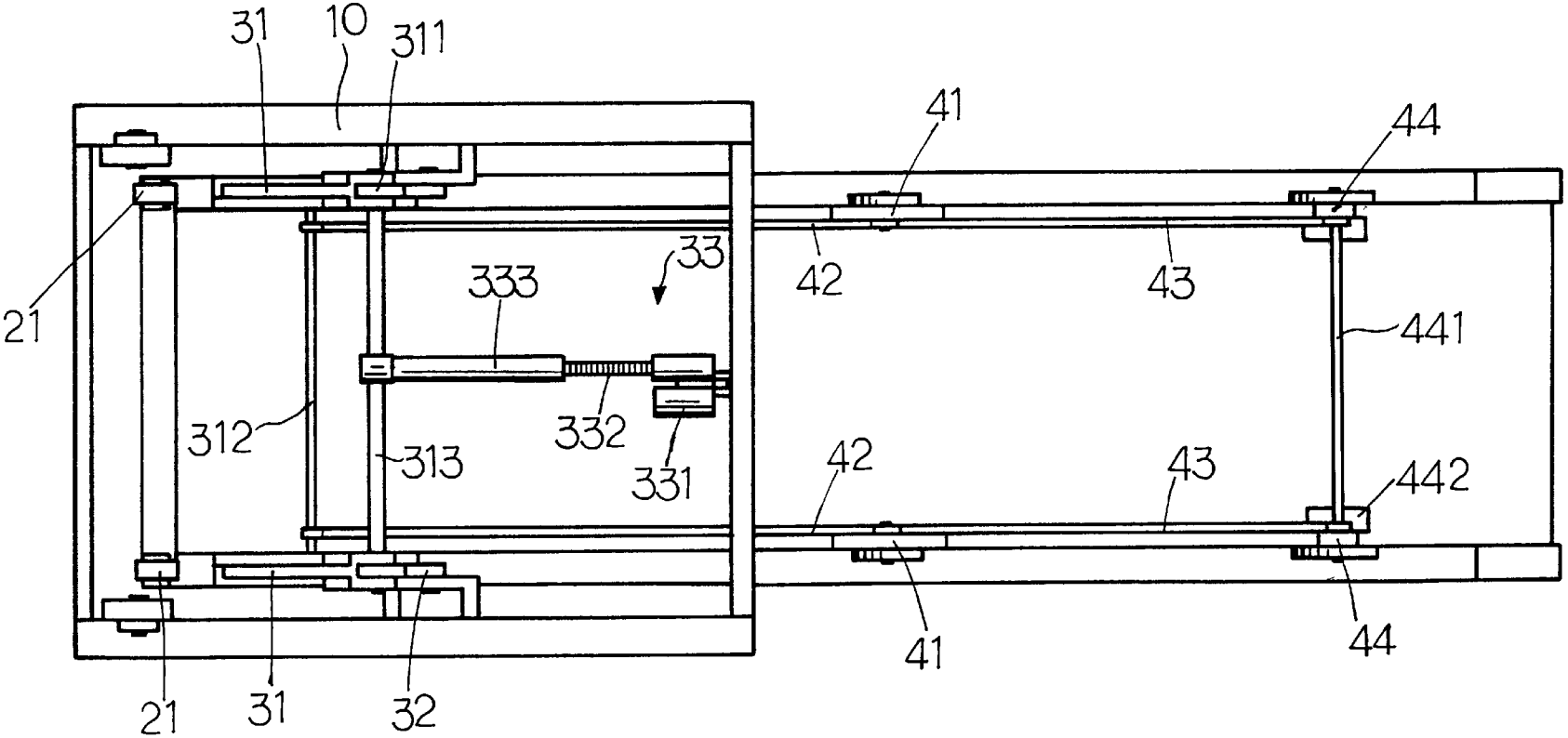
FIG. 1 is a top view illustrating the composition of the embodiment of the present invention.
Figure 2:
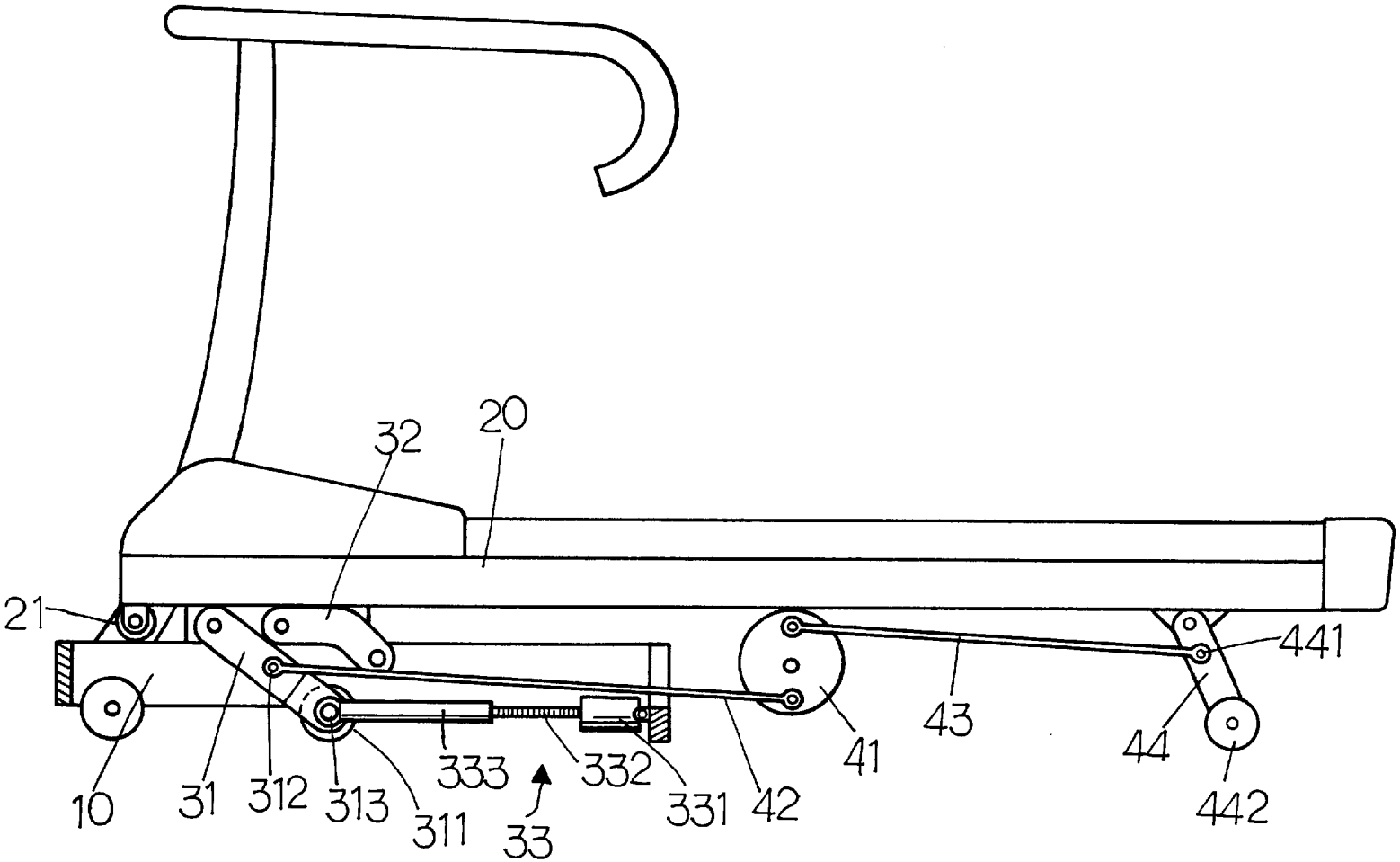
FIG. 2 is a, side view illustrating the composition of the embodiment of the present invention.

As illustrated in FIGS. 1 and 2, this present invention is a lifting and folding device comprising a base 10 and an exercise platform 20, between which an ascending/folding device 30 and a driving device 33 are installed. The ascending/folding device 30 comprises a pair of movable arms 31 and a pair of restrictive arms 32 that are pivotally connected in sequence to two lateral sides at the front part of the exercise platform 20. The other ends of the pair of restrictive arms 32 are pivotally connected to the corresponding sides of the base 10. The other ends of the pair of movable arms 31 are each pivot-jointed with a front wheel 311, which is in contact with the ground. Further, a first shaft 312 is installed between the movable arms 31 and a second shaft 313 connecting the centers of the front wheels 311 is installed pivotally. The second shaft 313, connected to a sleeve barrel 333 in front of a driving device 33, moves accordingly as the sleeve barrel 333 moves back and forth.

The other end of the driving device 33, mounted on the base 10, is composed of a motor 331 and a gear set, which is for driving a screw bolt 332 in a clockwise or counter-clockwise sense so as to move the sleeve barrel 333 coupled to it back and forth.

The interacting device 40 comprises a pair of positioning wheels 41, a pair of front links 42 and a pair of rear links 43. The positioning wheels 41 are symmetrically installed on two lateral sides underneath the exercise platform 20. Further, a front link 42 and a rear link 43 are respectively pivotally connected to opposite sides on each positioning wheel 41. The other ends of the front links 42 are pivotally connected to the above-mentioned first shaft 312, and the other ends of the rear links 43 are pivotally connected to an shafts 441 that connects the rear supporting arms 44 underneath the rear part of the exercise platform 20. Further, a pair of rear wheels 442 is installed at the bottom ends of the rear supporting arms 44.

As the exercise platform 20 resides in a horizontal state, as shown in FIG. 2, the movable arms 31 of the ascending/folding device 30 are about 30 degrees from the horizontal direction and the rear supporting arms 44 of the interacting device 40 depart slightly from the vertical direction (more specifically, the rear wheels 442 at the bottom ends of the rear supporting arms 44 are slightly oblique toward the outer edge of the exercise platform 20.). According to the above configuration, the front wheels 311 of the movable arms 31 and the rear wheels 442 of the rear supporting arms 44 are all in contact with the ground, achieving better stability of the exercise platform 20 when it is in an ascending or descending motion.

Figure 3:
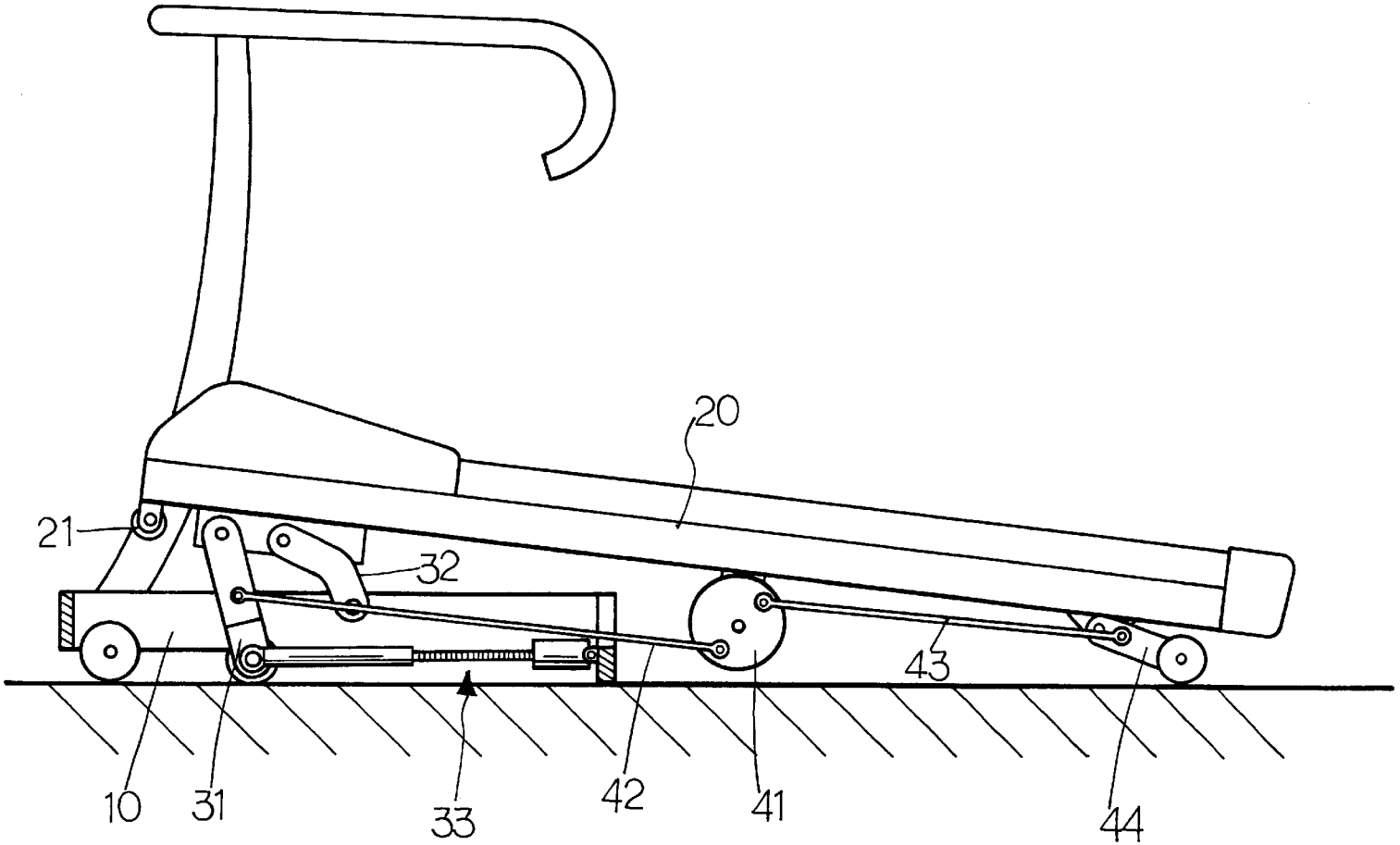
FIG. 3 is a side view illustrating an uphill configuration of the embodiment of the present invention.

As shown in FIG. 3, to adjust the exercise platform 20 to an uphill state, the motor 331 of the driving device 33 is started to push the sleeve barrel 333 forward so that the movable arm 31 is pushed upright, thereby ascending the front end of the exercise platform 20. At the same time when the movable arm 31 is pushed, the interacting device 40 moves accordingly. Firstly, the front links 42 connected to the first shaft 312 move forward, and secondly, since the other ends of the front links 42 are pivoted on one side of the positioning wheels 41, the rear links 43 pivoted on the opposite side move in the opposite direction (backward, in this case) by an effect of leverage about the wheel center. As a result, the rear supporting arms 44 as pushed outward by the rear links 43 become more oblique from the vertical position, and thereby the rear end of the exercise platform 20 becomes lower. During the process of adjustment, the front wheels 311 and the rear wheels 442 at four corners are in stable contact with the ground. The synchronic upward and downward movements at two ends of the exercise platform 20 achieve better efficiency of ascending the exercise platform 20.

Figure 4:
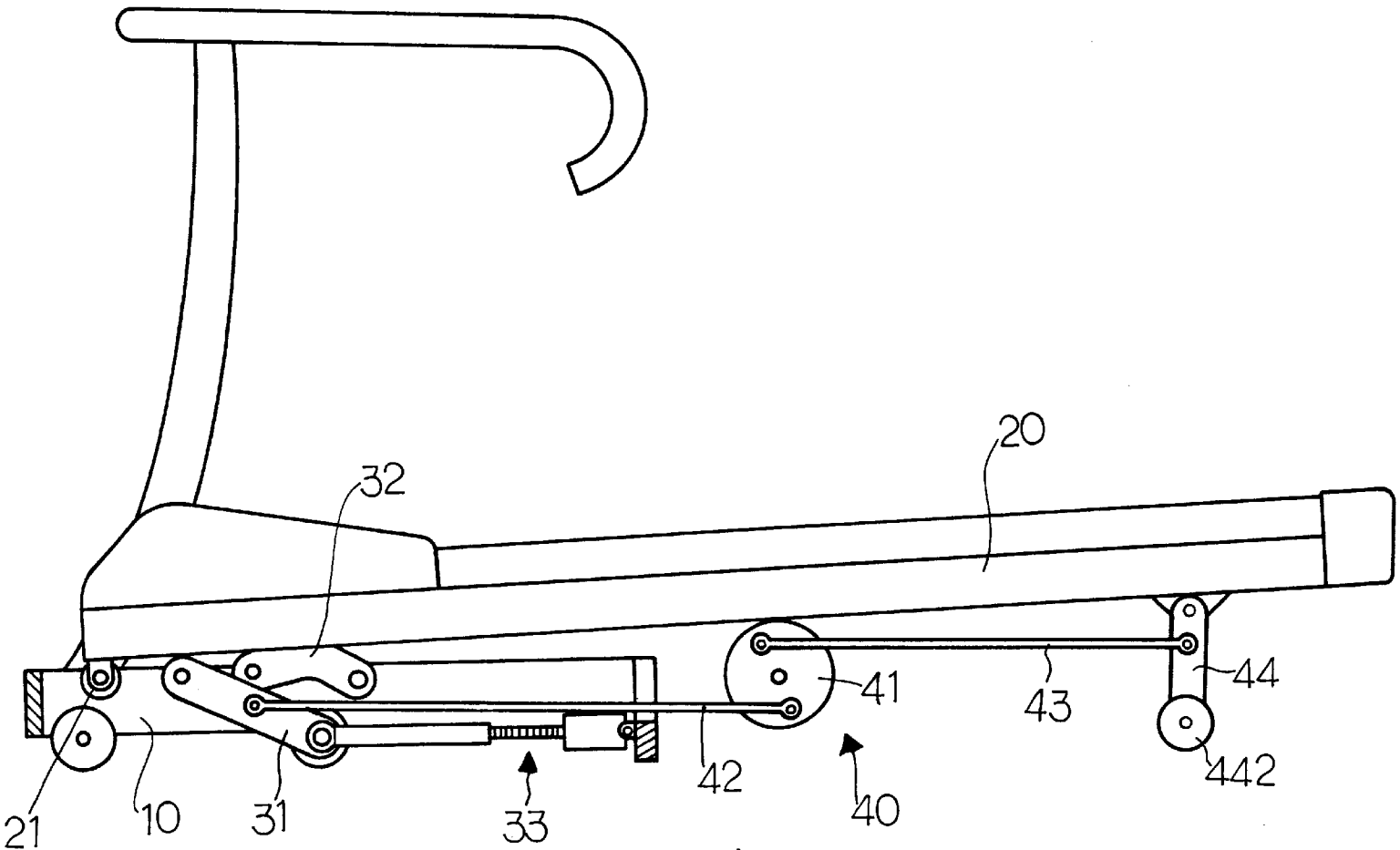
FIG. 4 is a side view illustrating a downhill configuration of the embodiment of the present invention.

As shown in FIG. 4, when the exercise platform 20 is adjusted toward a downhill configuration, the motor 331 drives the sleeve barrel 333 backward. Thereby putting the movable arms 31 and the front links 42 in a synchronic backward movement that accordingly sinks the front end of the exercise platform 20. Meanwhile, the positioning wheels 41 rotate in the direction of pulling the rear links 43 forward, and therefore the rear supporting arms 44 become more vertical and the rear end of the exercise platform 20 becomes higher. The above-mentioned process leads to an efficient adjustment of the exercise platform 20 to a downhill configuration.

Figure 5:
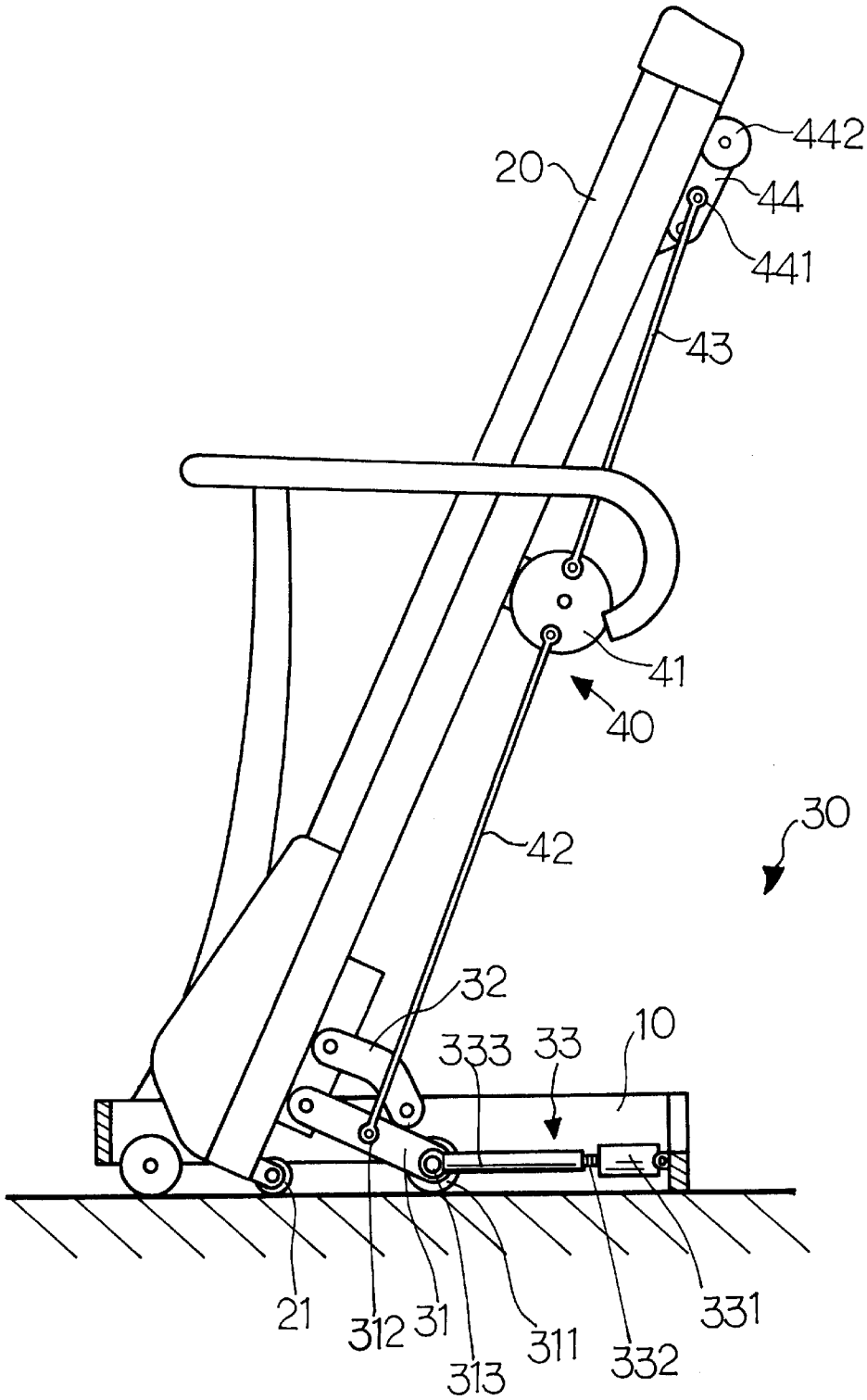
FIG. 5 is a side view illustrating the folded configuration of the embodiment of the present invention.

As a further function, according to the illustration of FIG. 5, as the motor 331 continues to drive the sleeve barrel 333 backward and synchronically the movable arms 31 move toward the motor 331, the restrictive arms 32 behind the movable arms 31, mounted between the base 10 and the exercise platform 20, take an effect of restrictive turning and thereby the exercise platform 20 is automatically folded into an upright position. Further, a pair of front pulleys 21 is installed under the front edge of the exercise platform 20 for assisting the running exercise machine being transported smoothly.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A lifting and folding device for a running exercise machine comprising an ascending/folding device and an interacting device; said ascending/folding device comprising a pair of movable arms and a pair of restrictive arms pivotally connected to two sides below a front end of an exercise platform; said pair of restrictive arms each having one end pivotally connected to a respective inner side of a base; said pair of movable arms each having a front wheel pivotally installed at one end thereof; a first shaft being rigidly installed between said pair of movable arms; a second shaft pivotally connecting to centers of said front wheels and coupled to a sleeve barrel of a driving device, thereby said second shaft moving synchronically with the movement of the said sleeve barrel; said sleeve barrel screwed onto a screw bolt at one end; said driving device having one end pivotally connected to said base, driving said screw bolt to rotate axially in either clockwise or counterclockwise direction by means of a motor and a gear set, so as to accomplish the function of moving said sleeve barrel back and forth; characterized in that:

said interacting device comprises a pair of positioning wheels installed pivotally on each of corresponding sides near a middle part under said exercise platform; a front link and a rear link pivotally connected to two ends about a pivot of said positioning wheel; another end of said front link without being connected to said positioning wheel is pivotally connected to said first shaft; another end of said rear link without being connected to said positioning wheel is pivotally connected to an shaft connecting a pair of rear supporting arms installed on two corresponding walls near the rear end of said exercise platform; thereby, as said ascending/folding device is driven by said driving device, said interacting device is put in motion synchronically, providing an adjustment of said exercise platform to an uphill or downhill configuration.

2. The ascending and folding device of a running exercise machine of claim 1, wherein each of said rear supporting arms has a front wheel installed at the bottom end thereof.

3. The ascending and folding device of a running exercise machine of claim 1, wherein two front wheels symmetrically arranged at rear ends on two lateral sides below said exercise platform, for providing a function of assisting sliding while said exercise platform is being folded into an upright configuration.

* * * * *